US009248658B2

(12) United States Patent
Mizutani et al.

(10) Patent No.: US 9,248,658 B2
(45) Date of Patent: Feb. 2, 2016

(54) LIQUID STORAGE CONTAINER AND COVER THEREFOR

(71) Applicant: SEIKO EPSON CORPORATION, Tokyo (JP)

(72) Inventors: Tadahiro Mizutani, Nagano (JP); Koichi Toba, Nagano (JP); Atsushi Kobayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/445,859

(22) Filed: Jul. 29, 2014

(65) Prior Publication Data

US 2015/0054892 A1 Feb. 26, 2015

(30) Foreign Application Priority Data

Aug. 26, 2013 (JP) ..... 2013-174070

(51) Int. Cl.
*B41J 2/175* (2006.01)

(52) U.S. Cl.
CPC ..... *B41J 2/17536* (2013.01); *B41J 2/1753* (2013.01); *B41J 2/17513* (2013.01); *B41J 2/17553* (2013.01); *B41J 2/17556* (2013.01)

(58) Field of Classification Search
CPC ..... B41J 2/17513
USPC ..... 347/86
See application file for complete search history.

(56) References Cited

U.S. PATENT DOCUMENTS

| | | | | |
|---|---|---|---|---|
| 6,082,852 | A * | 7/2000 | Soga et al. | 347/86 |
| 6,280,024 | B1 * | 8/2001 | Miyazawa et al. | 347/86 |
| 6,302,532 | B1 * | 10/2001 | Ishinaga et al. | 347/86 |
| 6,406,123 | B1 * | 6/2002 | Usui et al. | 347/29 |
| 6,470,799 | B2 * | 10/2002 | Nakazawa et al. | 101/466 |
| 6,644,796 | B2 * | 11/2003 | Olsen | 347/93 |
| 2008/0239037 | A1 | 10/2008 | Inoue et al. | |
| 2013/0314479 | A1 * | 11/2013 | Nozawa et al. | 347/86 |

FOREIGN PATENT DOCUMENTS

| | | |
|---|---|---|
| JP | 2008-246896 A | 10/2008 |
| JP | 2012-035489 A | 2/2012 |

* cited by examiner

*Primary Examiner* — Stephen Meier
*Assistant Examiner* — John P Zimmermann
(74) *Attorney, Agent, or Firm* — Global IP Counselors, LLP

(57) ABSTRACT

A liquid storage container includes a liquid storage part, a liquid supply part, a liquid outflow part, and a cover. The liquid storage part stores a liquid. The liquid supply part has a liquid supply port defining an opening by which the liquid is supplied to a liquid jet apparatus from the liquid storage part. The liquid outflow part is made of a porous material. The liquid outflow part is disposed inside of the liquid supply port and allows the liquid to flow out to the liquid jet apparatus from the liquid storage part. The cover includes a sealing part contacting with the liquid supply part and sealing off the liquid supply port, the sealing part and the liquid outflow part defining a space therebetween, and a contact part made of a non-porous material, the contact part contacting with a part of the liquid outflow part.

20 Claims, 17 Drawing Sheets

LIQUID STORAGE CONTAINER AND COVER THEREFOR

CROSS-REFERENCE TO RELATED APPLICATIONS

This application claims priority to Japanese Patent Application No. 2013-174070 filed on Aug. 26, 2013. The entire disclosure of Japanese Patent Application No. 2013-174070 is hereby incorporated herein by reference.

BACKGROUND

1. Technical Field

The present invention relates to a liquid storage container and a cover therefor.

2. Related Art

One known liquid storage container is a cartridge for storing ink (a print material) for supply to a printer (print apparatus). Such a cartridge is provided with a liquid supply part and a liquid outflow part. The liquid supply part of the cartridge is provided with a liquid supply port, which is an opening configured so that the ink can be supplied to the printer. The liquid outflow part of the cartridge is formed of a filter, which is a porous medium made of a porous material, and is provided to the inside of the liquid supply port and causes the ink to flow out to the printer by capillary force. In the state before the cartridge is mounted onto printer, a cover (also called a cap or a lid) for closing off the liquid supply port is mounted onto the cartridge in order to prevent the ink from flowing out from the cartridge (see JP-A-2008-246896 (Patent Document 1), for example).

SUMMARY

The cartridge of Patent Document 1 has a problem in that ink that has leaked out to inside the cover from the liquid outflow part in the state where the cover has been mounted onto the cartridge cannot be used for printing and goes to waste. There has therefore been a desire for a feature making it possible to curb the waste of ink in the cartridge.

There has additionally been a desire to reduce size, conserve resources, facilitate manufacturing, improve usability, and the like in the cartridge. The problems described are not limited to cartridges for storing ink, but rather are common also to liquid storage containers for storing other liquids.

The present invention has been made in order to resolve the foregoing problems at least in part, and can be implemented as the following modes.

(1) According to one aspect of the present invention, a cover is configured to be mounted onto a liquid storage container that includes a liquid storage part configured to store a liquid for supply to a liquid jet apparatus, a liquid supply part having a liquid supply port that defines an opening by which the liquid is supplied to the liquid jet apparatus from the liquid storage part, and a liquid outflow part made of a porous material, the liquid outflow part being disposed inside of the liquid supply port and allowing the liquid to flow out to the liquid jet apparatus from the liquid storage part. The cover is further configured to block off the liquid supply port. This cover includes a sealing part contacting with the liquid supply part and sealing off the liquid supply port in a state where the cover is mounted onto the liquid storage container, the sealing part and the liquid outflow part defining a space therebetween, and a contact part made of a non-porous material, the contact part contacting with a part of the liquid outflow part in the state where the cover is mounted onto the liquid storage container. According to this aspect, a capillary force oriented toward the liquid outflow part can be made to act on the liquid that is present between the liquid outflow part and the contact part. This makes it possible to gather, to the liquid outflow part, the liquid that is present at the periphery of the contact part out of the liquid that has leaked out to the cover from the liquid outflow part. The liquid that is gathered to the liquid outflow part in this manner is returned to the liquid storage part by way of the liquid outflow part because of a negative pressure inside the liquid storage part. As such, the extent to which the liquid that has leaked out to the cover from the liquid outflow part goes to waste can be curbed.

(2) The cover of the above aspect can be further configured such that the liquid supply part of the liquid storage container further has a communication port that communicates between the space and the air in the state where the cover is mounted onto the liquid storage container, and such that the contact part contacts with a site on the communication port side in the liquid outflow part in the state where the cover is mounted onto the liquid storage container. According to this aspect, the liquid can be returned to the liquid storage part via the contact part in advance of the communication port when the liquid that has leaked out to the cover from the liquid outflow part is flowing to the communication port side. This makes it possible to curb the extent to which the liquid flows into the communication port, and therefore makes it possible to curb the extent to which liquid that has flowed into the communication port becomes unusable liquid and goes to waste.

(3) The cover of the above aspect can be further configured such that the liquid supply part of the liquid storage container further has a welded part that surrounds the liquid outflow part, the welded part being obtained when the porous material is welded, such that the contact part projects out from the sealing part, the contact part having an inclined part that is inclined with respect to a middle part of the liquid outflow part and contacts with the liquid outflow part in the state where the cover is mounted onto the liquid storage container, and an upper part that is connected to the inclined part and defines a top of the contact part, and such that the upper part has a groove that extends from the communication port side to the inclined part side. According to this aspect, causing a capillary force going toward the inclined part to act on the liquid that is present in the groove of the upper part makes it possible to gather, to the liquid outflow part via the groove of the upper part, the liquid that has come around to the opposite side of the inclined part in the contact part out of the liquid that has leaked out to the cover from the liquid outflow part. As such, the extent to which liquid that has leaked out to the cover from the liquid outflow part goes to waste can be curbed even further.

(4) The cover of the above aspect can be further configured such that the liquid supply part of the liquid storage container has a welded part that is obtained when the porous material is welded, and such that the contact part has a facing part that faces the welded part in the state where the cover is mounted onto the liquid storage container. According to this aspect, the facing part comes up against the welded part, thereby making it possible to prevent damage to the liquid outflow part by an excessive pressing of the contact part.

(5) The cover of the above aspect can be further configured such that the facing part contacts with the welded part in the state where the cover is mounted onto the liquid storage container. According to this aspect, the facing part makes it possible to hinder the flow of the liquid going toward the outside of the liquid outflow part beyond the welded part. As such, the extent to which liquid that has leaked out to the cover from the liquid outflow part goes to waste can be curbed even further.

(6) The cover of the above aspect can be further configured such that the facing part and the welded part define a space therebetween where a capillary force going toward the liquid outflow part is made to act on the liquid that is present between the facing part and the welded part in the state where the cover is mounted onto the liquid storage container. According to this aspect, it is possible to gather, to the liquid outflow part via the space between the facing part and the welded part, the liquid that is present at the periphery of the facing part out of the liquid that has leaked out to the cover from the liquid outflow part. As such, the extent to which liquid that has leaked out to the cover from the liquid outflow part goes to waste can be curbed even further.

(7) The cover of the above aspect can be further configured such that the liquid supply part of the liquid storage container has a welded part that is obtained when the porous material is welded. The cover further includes a surrounding part that contacts with the welded part and surrounds the liquid outflow part in the state where the cover is mounted onto the liquid storage container, the surrounding part having an opening that links inside of the surrounding part to the air in the state where the cover is mounted onto the liquid storage container. According to this aspect, the surrounding part makes it possible to hinder the ink that has leaked out to the cover from the liquid outflow part from drawing away from the liquid outflow part, while also the opening of the surrounding part makes it possible to prevent the air that is present in between the inside of the surrounding part and the liquid outflow part from entering into the liquid storage part by way of the liquid outflow part because of a change in air pressure. This makes it possible to effectively gather, to the liquid outflow part, the liquid that has leaked out to the cover.

The plurality of constituent elements in each of the aspects of the present invention described above are not all essential, but rather some of the plurality of constituent elements can undergo modifications, deletions, replacement with other new constituent elements, or partial deletion of the limiting content, as appropriate, in order to solve the aforementioned problems in part or in total, or in order to achieve in part or in total the effects that are described in the present description. It would also be possible to combine some or all of the technical features included in one aspect of the present invention described above with some or all of the technical features included in another aspect of the present invention described above to make an independent aspect of the present invention, in order to solve the aforementioned problems in part or in total, or in order to achieve in part or in total the effects that are described in the present description.

For example, one example of the present invention can be implemented as an apparatus provided with one element out of the two elements of the sealing part and the contact part. That is to say, an apparatus of the present invention can have but need not have the sealing part. Also, an apparatus of the present invention can have but need not have the contact part.

The sealing part can be configured as, for example, a sealing part for contacting with the liquid supply part in a state where the apparatus has been mounted onto the liquid storage container, and thereby sealing off the liquid supply port. Also, the sealing part and the liquid outflow part forming a space therebetween. The contact part can be configured as, for example, a contact part which is made of a non-porous material and contacts with a part of the liquid outflow part in the state where the apparatus has been mounted onto the liquid storage container.

Such an apparatus can be implemented as, for example, a cover, but could also be implemented as another apparatus other than a cover. According to such an aspect, at least one of a variety of problems, such as reducing the apparatus scale, lowering costs, conserving resources, simplifying manufacture, and improving usability, can be solved. Some or all of the technical features of each of the aspects of the cover described above can all be applied to such an apparatus.

The present invention can also be implemented with a variety of aspects other than a cover. For example, the present invention can be implemented with an aspect such as a method for manufacturing a cover, a liquid storage container provided with a cover, or a method for manufacturing a liquid storage container.

BRIEF DESCRIPTION OF THE DRAWINGS

Referring now to the attached drawings which form a part of this original disclosure.

DETAILED DESCRIPTION OF EXEMPLARY EMBODIMENTS

A. First Embodiment

A-1. Overall Configuration of the Liquid Jet System

Figure 1:
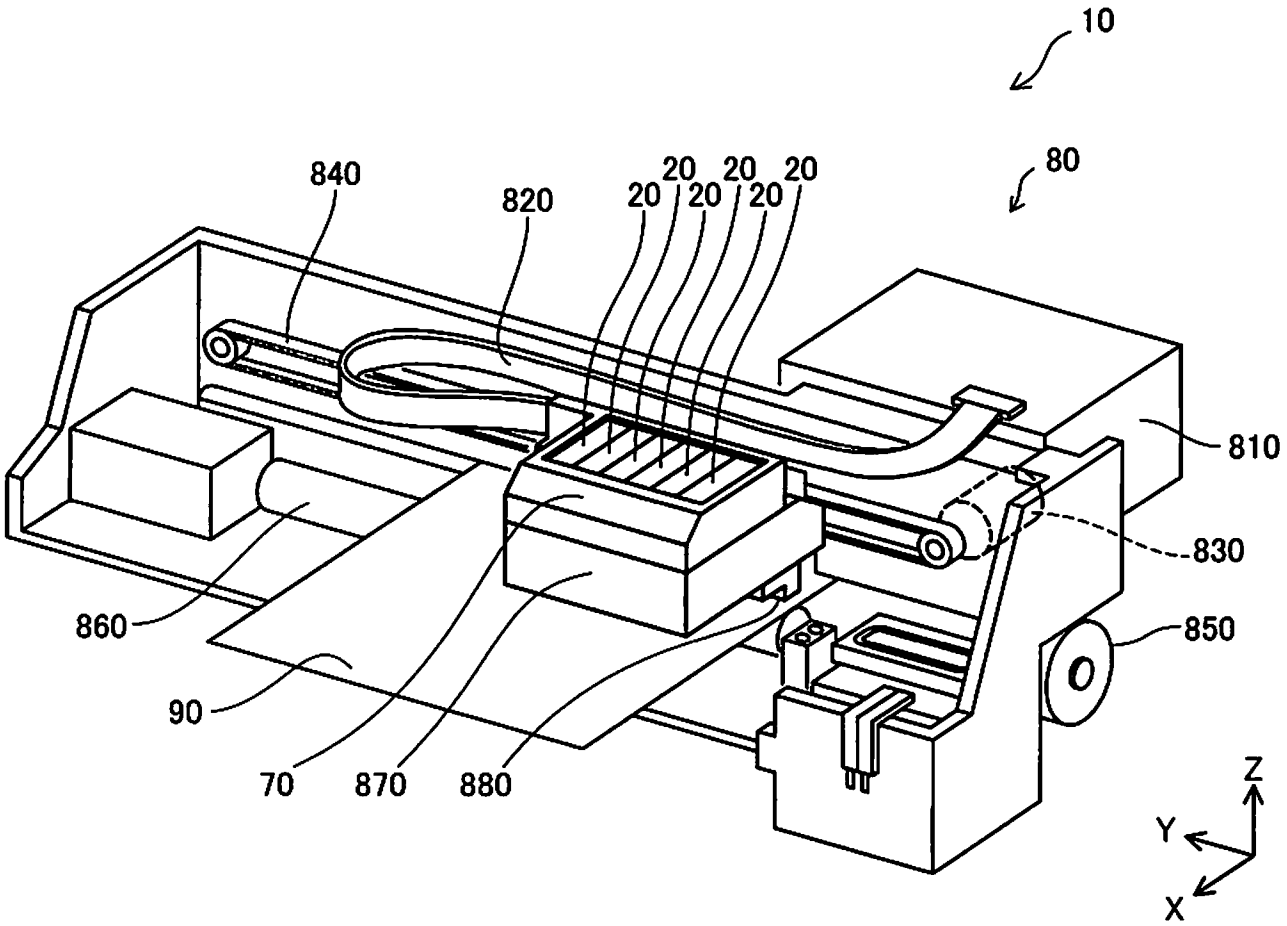
FIG. 1 is a perspective view illustrating the configuration of a liquid jet system.

FIG. 1 is a perspective view illustrating the configuration of a liquid jet system 10. FIG. 1 illustrates X-, Y-, and Z-axes, which are orthogonal to one another. The X-, Y-, and Z-axes in FIG. 1 correspond to the X-, Y, and Z-axes in the other drawings. In the present embodiment, the Z-axis in the X-, Y-, and Z-axes is an axis that runs along the force of gravity in the state of use of the liquid jet system 10. The +Z-axis direction is the upward direction opposite to the direction of the force of gravity, and the −Z-axis direction is the direction of the force of gravity, i.e., the downward direction. The "state of use of the liquid jet system 10" refers to a state where the liquid jet system 10 is installed on a horizontal plane; in the present embodiment, the XY-plane is the horizontal plane.

The liquid jet system 10 is provided with cartridges 20, which are liquid storage containers, and with a printer 80, which is a liquid jet apparatus. In the present embodiment, the cartridges 20 are so-called ink cartridges, and the printer 80 is a so-called ink jet printer. The printer 80 is provided with a holder 70 for holding the cartridges 20. The cartridges 20 are configured so as to be detachable with respect to the holder 70. The cartridges 20 supply ink, which is a liquid print material, to the printer 80. The printer 80 prints information such as text, graphics, and images onto a print medium 90, such as paper or labels, by jetting the ink coming from the cartridges 20 as droplets onto the print medium 90.

In the present embodiment, the holder 70 is configured so that a plurality of the cartridges 20 can be mounted. In the present embodiment, there is one of each of six types of cartridges 20, i.e., a total of six cartridges 20 mounted onto the holder 70 so as to correspond to inks for six colors (black, yellow, magenta, light magenta, cyan, and light cyan). The number of the cartridges 20 that can be mounted onto the holder 70 is not limited to being six and can be modified to any arbitrary number, which can be fewer than six or can be greater than six. The types of ink of the cartridges 20 are not limited to being six in number, and can be fewer than six types or can be greater than six types.

The printer 80 of the liquid jet system 10 is provided not only with the holder 70 but also with a control part 810, a carriage 870, and a print head 880. The control part 810 controls each of the parts of the printer 80. The carriage 870 is configured so as to be able to move the print head 880 in a relative manner with respect to the print medium 90. The print head 880 jets the inks coming from the cartridge 20 onto the print medium 90 on the basis of a control signal coming from the control part 810. In the present embodiment, the print head 880 is electrically connected to the control part 810 via a flexible cable 820.

In the present embodiment, the holder 70 for holding the cartridges 20 is arranged on the carriage 870 along with the print head 880. The printer of such description is also called an on-carriage type. In another embodiment, the holder 70 for holding the cartridges 20 can be arranged at a site different from that of the carriage 870. A printer of such description is also called an off-carriage type; the ink of the cartridges 20 is supplied to the print head 880 of the carriage 870 via flexible tubes (not shown).

In the present embodiment, the printer 80 is provided with a main scan feed mechanism and a sub-scan feed mechanism for causing the carriage 870 and the print medium 90 to move in a relative manner and executing printing. The main scan feed mechanism of the printer 80 causes the carriage 870 to move reciprocally in a main scan direction, by transmitting the power of a carriage motor 830 to the carriage 870 via a drive belt 840 on the basis of a control signal coming from the control part 810. The sub-scan feed mechanism of the printer 80 conveys the print medium 90 in a sub-scan direction orthogonal to the main scan direction, by transmitting the power of a conveyance motor 850 to a platen 860 on the basis of a control signal coming from the control part 810.

In the present embodiment, in the state of use of the liquid jet system 10, the X-axis in the X-, Y-, and Z-axes is an axis that runs along the sub-scan direction, and the Y-axis in the X-, Y-, and Z-axes is an axis that runs along the main scan direction. In a case where the side at which the print medium 90 is discharged during printing is understood to be the front of the liquid jet system 10, then the +X-axis direction is the front direction going toward the front from the rear of the liquid jet system 10, and the −X-axis direction is the rear direction going toward the rear from the front of the liquid jet system 10. In such a case, the +Y-axis direction is the left direction going toward the left side of the liquid jet system 10, and the −Y-axis direction is the right direction going toward the right side of the liquid jet system 10.

A-2. Detailed Configuration of the Holder

Figure 2:
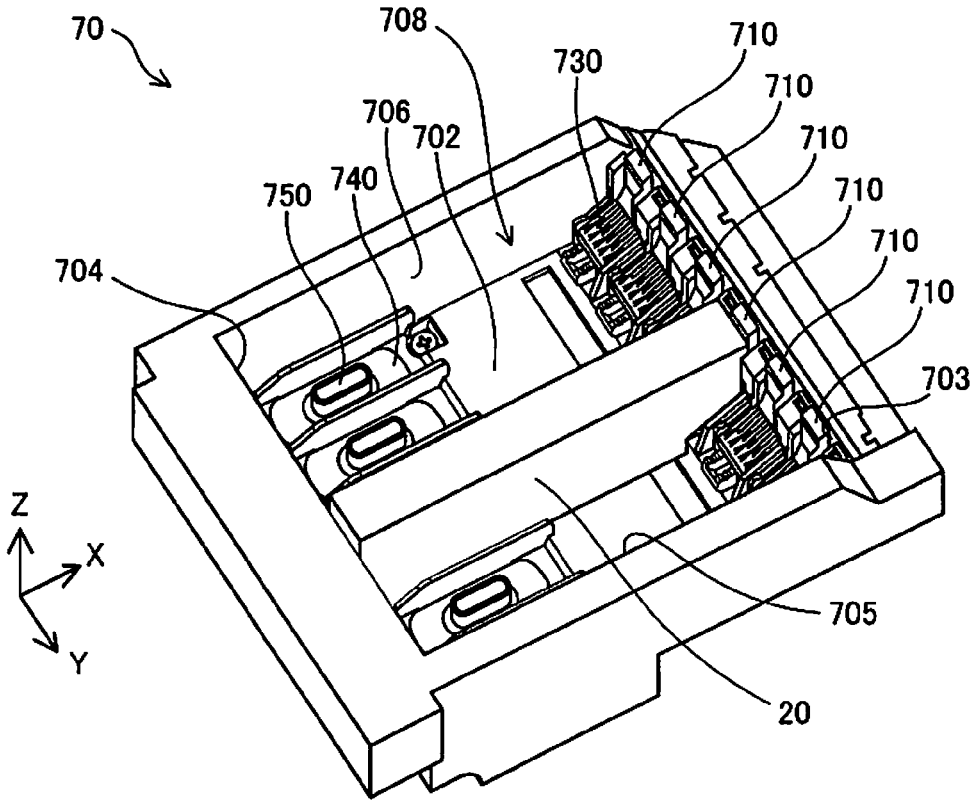
FIG. 2 is a perspective view where a holder is seen obliquely from above.

FIG. 2 is a perspective view where the holder 70 is seen obliquely from above. In the example in FIG. 2, the holder 70 has one cartridge 20 mounted thereon.

In the holder 70, a space 708 where the cartridges 20 are contained is demarcated by five walls 702, 703, 704, 705, 706. The wall 702 is located on the −Z-axis direction side. The wall 703 is located on the +X-axis direction side and the wall 704 is located on the −X-axis direction side. The wall 705 is located on the +Y-axis direction side and the wall 706 is located on the −Y-axis direction side.

The holder 70 is provided with levers 710, terminal blocks 730, seal members 740, and supply tubes 750 so as to correspond to each one of the cartridges 20 stored in the space 708. The levers 710 fix the cartridges 20 in the space 708 by engaging with the cartridges 20, and also are configured so that the cartridges 20 can be taken out from the space 708 by an operation by a user. The terminal blocks 730 are configured so as to be electrically connectable to the cartridges 20. The seal members 740 are provided to the periphery of the supply tubes 750, and prevent the ink from leaking out to the periphery of the supply tubes 750 by being attached firmly to the cartridges 20. The supply tubes 750 form flow paths through which the ink supplied from the cartridges 20 is supplied to the print head 880.

A-3. Detailed Configuration of the Cartridge

Figure 3:
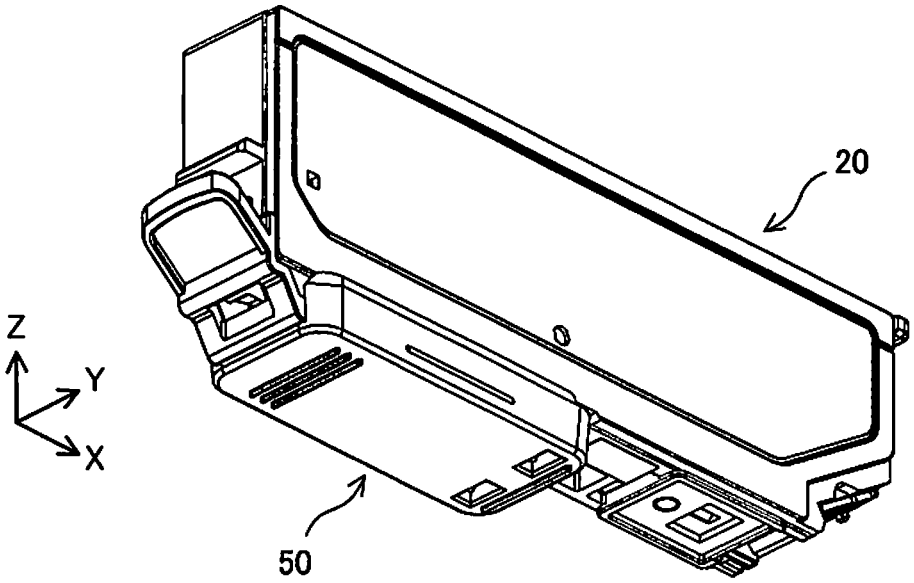
FIG. 3 is a perspective view where a cartridge onto which a cover has been mounted is viewed obliquely from below.

FIG. 3 is a perspective view where the cartridge 20 onto which a cover 50 is mounted is viewed obliquely from below. In a state before the cartridge 20 is mounted onto the holder 70, the cover 50 is mounted onto the cartridge 20 in order to prevent the ink from leaking out from the cartridge 20. The cover 50 is also called a cap or lid. In the present embodiment, the cover 50 is mounted onto the cartridge 20 in a step for manufacturing the cartridge 20, and is removed from the cartridge 20 by the user immediately before being mounted onto the holder 70. The detailed configuration of the cover 50 shall be described below.

Figure 4:
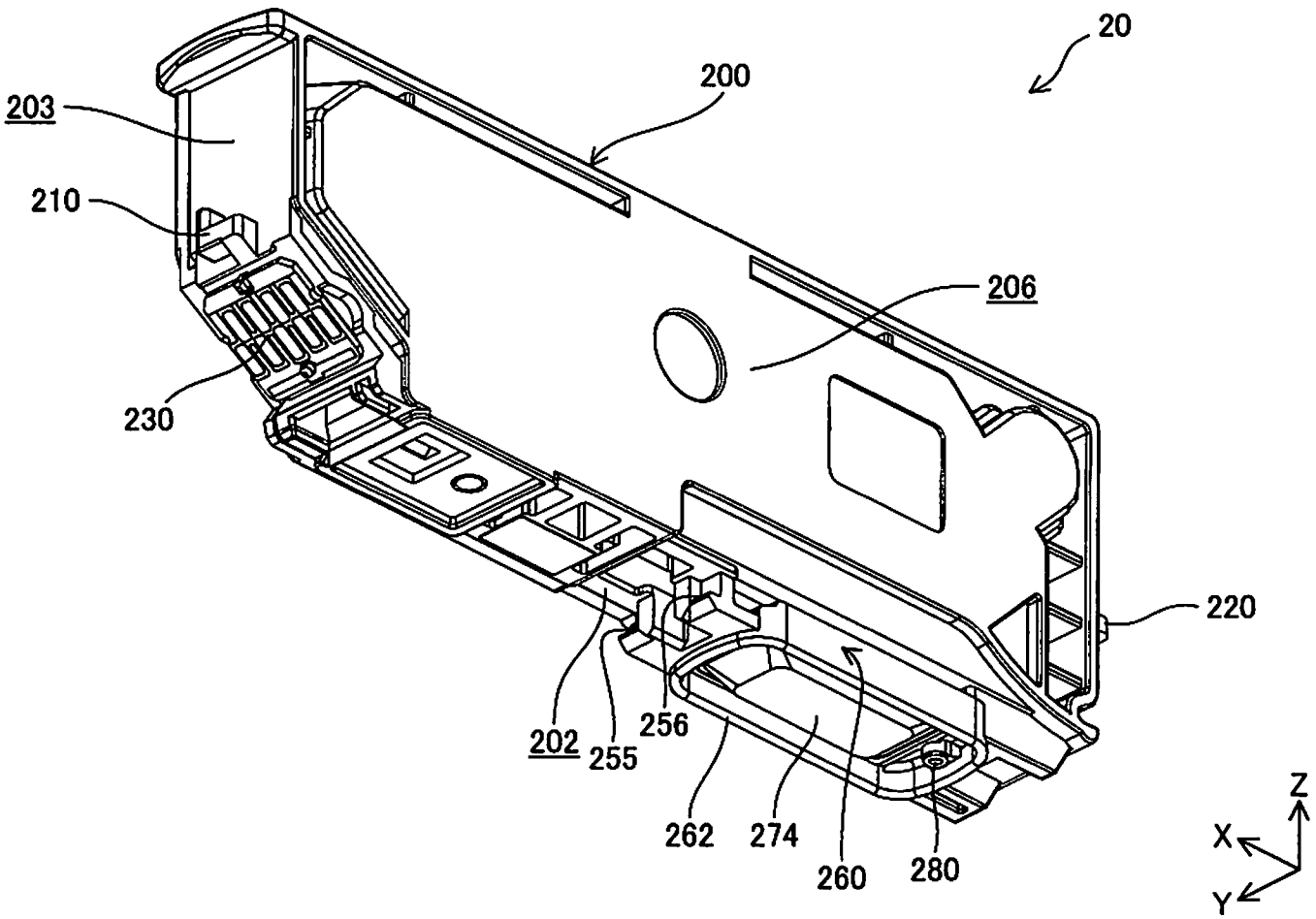
FIG. 4 is a perspective view where a cartridge is viewed obliquely from below.
Figure 5:
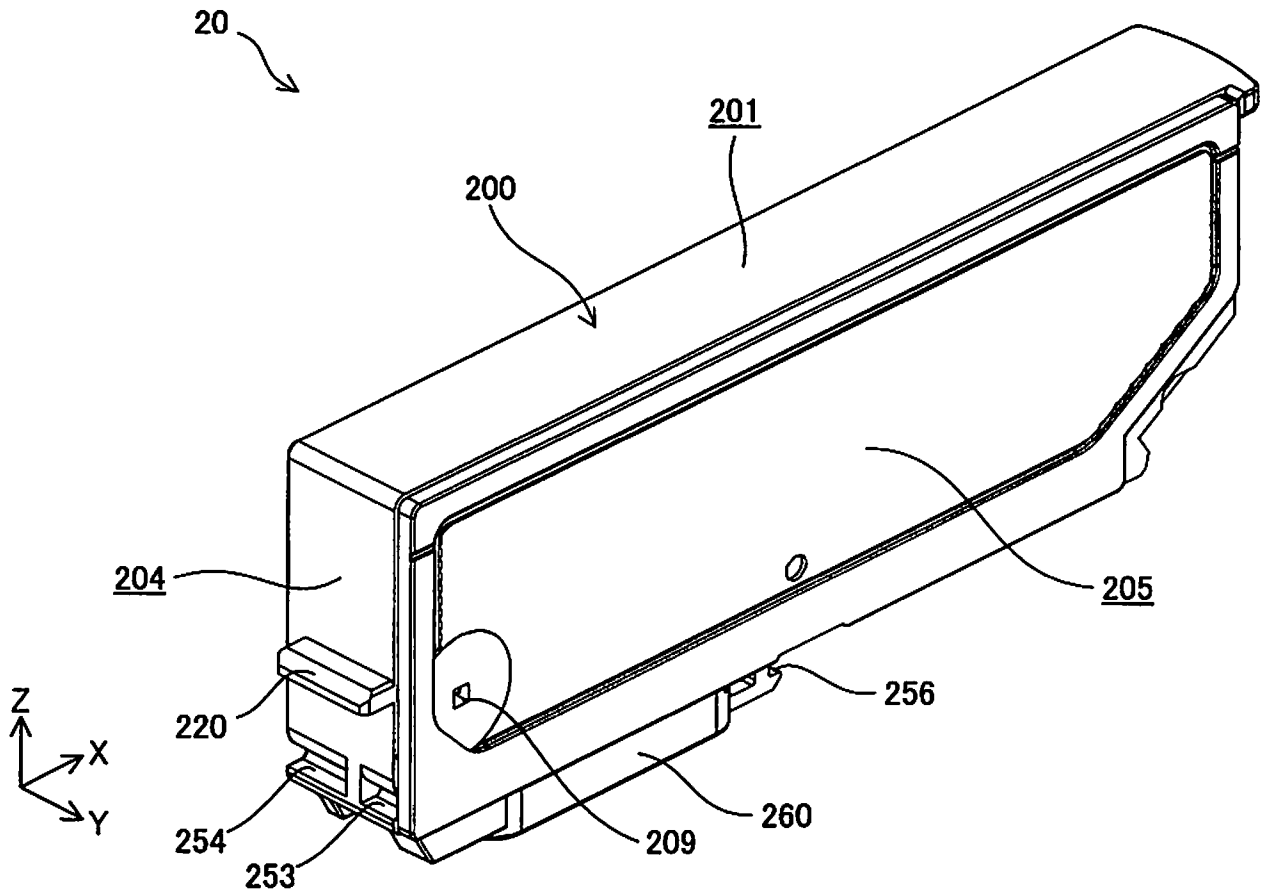
FIG. 5 is a perspective view where a cartridge is viewed obliquely from above.
Figure 6:
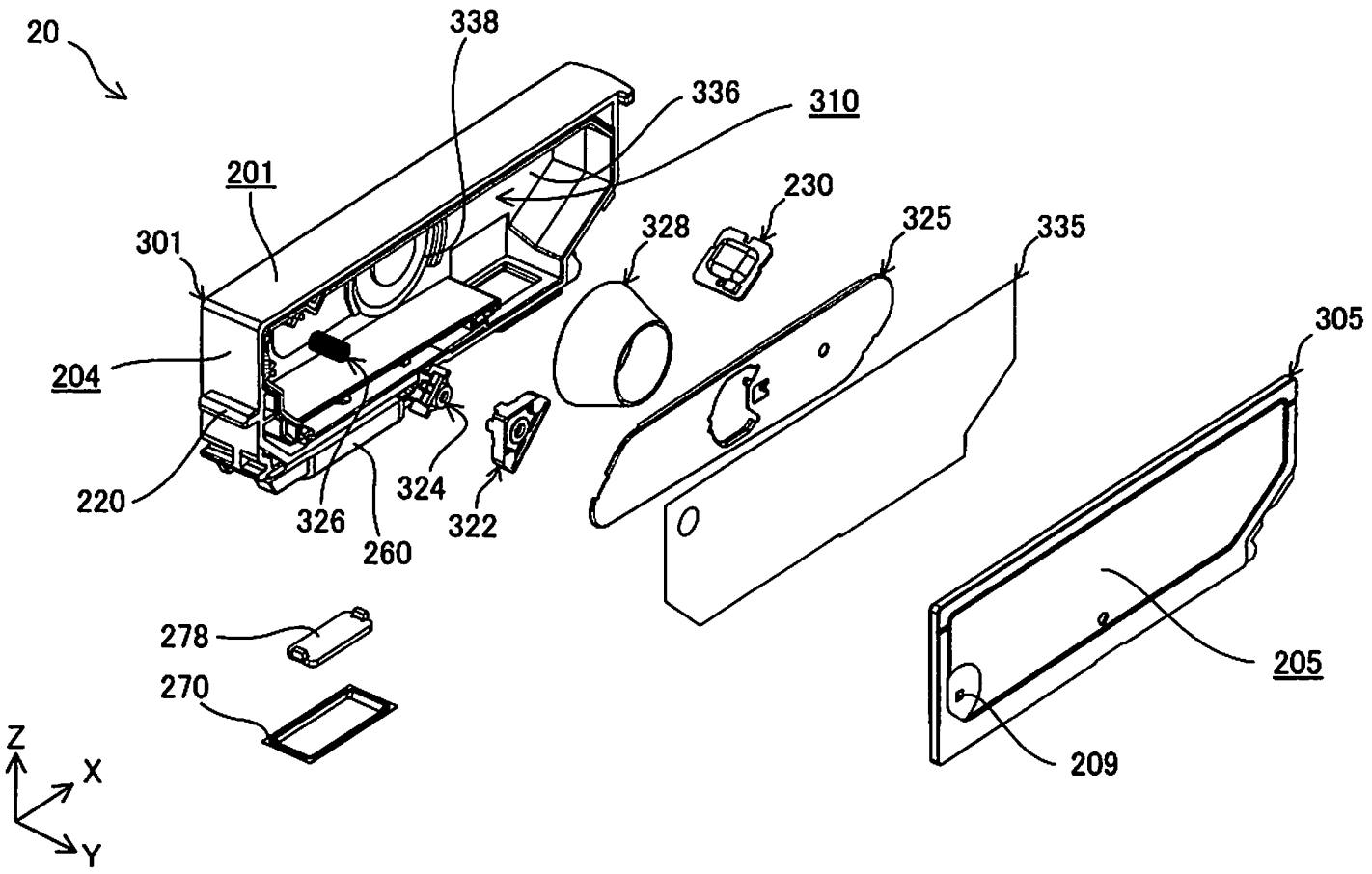
FIG. 6 is an exploded perspective view illustrating the internal configuration of a cartridge.

FIG. 4 is a perspective view where the cartridge 20 is viewed obliquely from below. FIG. 5 is a perspective view where the cartridge 20 is viewed obliquely from above. FIG. 6 is an exploded perspective view illustrating the internal configuration of the cartridge 20. When the cartridge 20 is described, the X-, Y-, Z-axes with respect to the cartridge 20 in a state of having been mounted onto the holder 70 are understood to be the axes on the cartridge 20.

The cartridge 20 is provided with an outer casing 200, which is based on a rectangular parallelepiped. The cartridge 20 is provided with six walls 201, 202, 203, 204, 205, 206 forming the outer casing 200. The wall 201 is located on the +Z-axis direction side and the wall 202 is located on the −Z-axis direction side. The wall 203 is located on the +X-axis direction side and the wall 204 is located on the −X-axis direction side. The wall 205 is located on the +Y-axis direction side and the wall 206 is located on the −Y-axis direction side.

In the present embodiment, as illustrated in FIG. 6, the cartridge 20 is provided with a main body member 301 forming the walls 201, 202, 203, 204, 206 and a side surface member 305 forming the wall 205, as members forming the outer casing 200. In the present embodiment, the main body member 301 and the side surface member 305 are made of a synthetic resin (for example, polypropylene (PP) or polyacetal (POM)).

The cartridge 20 is provided with a liquid storage part 310 on the inside of the outer casing 200. The liquid storage part 310 is for storing the ink, as the liquid for supply to the printer 80. In the present embodiment, the cartridge 20 is provided not only with the main body member 301 but also with a film member 335 welded to the main body member 301, as members forming the liquid storage part 310. In the present embodiment, the film member 335 is made of a synthetic resin (for example, nylon and polypropylene composites).

In the present embodiment, the cartridge 20 is provided with a valve member 322, a valve member 324, a plate member 325, an elastic member 326, and an elastic member 328 as members for adjusting the internal pressure of the liquid storage part 310. The elastic member 328 pushes against the film member 335, with the plate member 325 interposed therebetween, in the direction by which the volume of the liquid storage part 310 is expanded. The internal pressure of the liquid storage part 310 is thereby maintained at a pressure (negative pressure) lower than the atmospheric pressure. In a case where the consumption of the ink in the liquid storage part 310 causes the internal pressure of the liquid storage part 310 to fall below a reference value, then the valve member 322, the valve member 324, and the elastic member 326 temporarily introduce air to the liquid storage part 310 by way of an air inlet 209. The internal pressure of the liquid storage part 310 is thereby maintained in an appropriate range of pressure.

The cartridge 20 is provided with a convexity 210, a convexity 220, a circuit board 230, concavities 253, 254, concavities 255, 256, a liquid supply part 260, a liquid supply port 262, a liquid outflow part 274, and a communication port 280.

The convexity 210 of the cartridge 20 is formed on the wall 203. In a state where the cartridge 20 has been mounted onto the holder 70, the convexity 210 engages with the lever 710 of the holder 70. The +X-axis direction side of the cartridge 20 is thereby positioned with respect to the holder 70.

The convexity 220 of the cartridge 20 is formed on the wall 204. In the state where the cartridge 20 has been mounted onto the holder 70, the convexity 220 engages with the wall 704 of the holder 70. The −X-axis direction side of the cartridge 20 is thereby positioned with respect to the holder 70.

The circuit board 230 of the cartridge 20 is provided to between the wall 202 and the wall 203. In the state where the cartridge 20 has been mounted onto the holder 70, the circuit board 230 is electrically connected by contact with the terminal block 730 of the holder 70. The circuit board 230 stores information (for example, the color of ink, the remaining amount of ink; and the like) relating to the ink stored in the liquid storage part 310.

The concavities 253, 254 of the cartridge 20 are formed on the −X-axis direction side of the liquid supply part 260. The concavity 253 is located on the +Y-axis direction side and the concavity 254 is located on the −Y-axis direction side. In the state where the cover 50 has been mounted onto the cartridge 20, the concavities 253, 254 engage with the cover 50. The −X-axis direction side of the cover 50 is thereby positioned with respect to the cartridge 20.

The concavities 255, 256 of the cartridge 20 are formed on the +X-axis direction side of the liquid supply part 260. The concavity 255 is located on the +Y-axis direction side and the concavity 256 is located on the −Y-axis direction side. In the state where the cover 50 has been mounted onto the cartridge 20, the concavities 255, 256 engage with the cover 50. The +X-axis direction side of the cover 50 is thereby positioned with respect to the cartridge 20.

Figure 7:
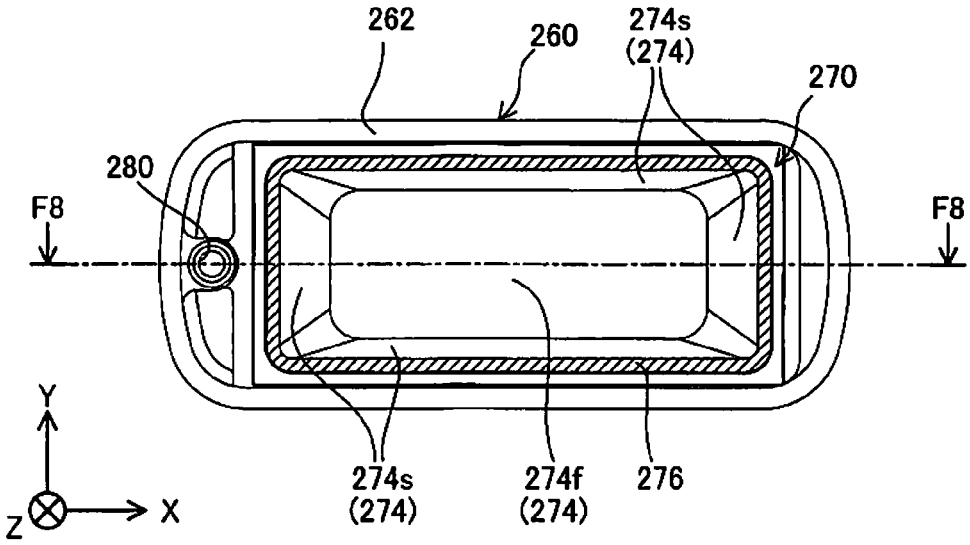
FIG. 7 is an enlarged view where a liquid supply part is viewed from below.
Figure 8:
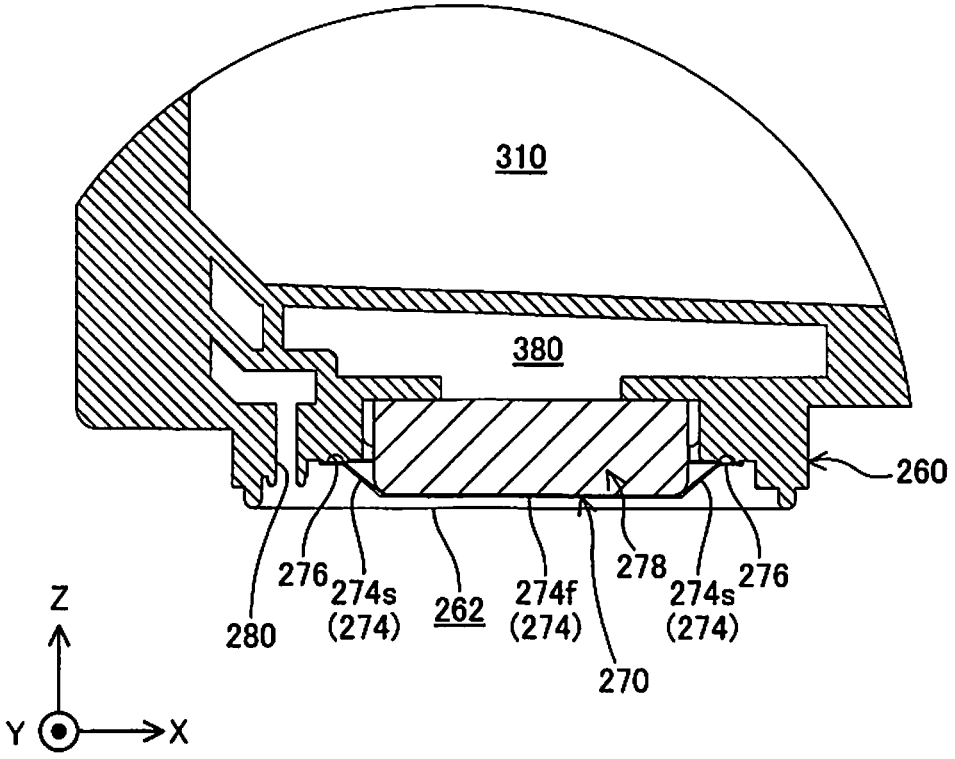
FIG. 8 is a cross-sectional view where a liquid supply part is transected.

FIG. 7 is an enlarged view where the liquid supply part 260 is viewed from below. FIG. 8 is a cross-sectional view where the liquid supply part 260 is transected. FIG. 7 depicts the liquid supply part 260 as seen from the −Z-axis direction. FIG. 8 depicts the liquid supply part 260 as transected along the arrow F8-F8 in FIG. 7.

Provided to the liquid supply part 260 of the cartridge 20 is the liquid supply port 262, which is an opening configured so that the ink can be supplied to the printer 80 from the liquid storage part 310. In the present embodiment, the liquid supply part 260 forms a cylindrical shape that projects out in the −Z-axis direction from the wall 202, and has the liquid supply port 262 on the −Z-axis direction side. In the present embodiment, the liquid supply port 262 forms a ring shape obtained when the corners of a rectangle are rounded. In another embodiment, the liquid supply port 262 can form a circle, ellipse, oval, square, or rectangle, or another ring shape.

The liquid outflow part 274 of the cartridge 20 is provided to the inside of the liquid supply part 260, and allows the ink to flow out from the liquid storage part 310 to the printer 80. In the present embodiment, in the state where the cartridge 20 has been mounted onto the holder 70, then the liquid outflow part 274 is connected to the supply tube 750 of the holder 70, and the ink of the liquid storage part 310 is supplied to the print head 880 of the printer 80 from the liquid outflow part 274 by way of the supply tube 750.

The liquid outflow part 274 is formed of a filter 270 in the form of a film that has a plurality of pores. The filter 270 is a porous medium made of a porous material. A meniscus, which is an interface between the air and the ink, is formed in the pores in the liquid outflow part 274. The menisci formed in the liquid outflow part 274 prevent the entry of air to inside the liquid outflow part 274, and also prevent the leakage of ink out from the liquid outflow part 274. In the present embodiment, the filter 270 is formed of a synthetic resin (for example, polyethylene terephthalate).

In the present embodiment, a welded part 276 that is formed in association with the welding of the filter 270 to the inside of the liquid supply port 262 is formed on the liquid supply part 260. The welded part 276 has been hatched in FIG. 7. At the welded part 276, the pores of the filter 270 are lost during the welding. The welded part 276 therefore is impermeable to the ink.

In the present embodiment, the liquid outflow part 274 is pressed toward the −Z-axis direction by a form 278 from the +Z-axis direction side. The liquid outflow part 274 thereby protrudes out to the −Z-axis direction side beyond the welded part 276. The form 278 is adjacent to a secondary storage part 380 forming a part of the liquid storage part 310, and forms a flow path through which the ink flows to the liquid outflow part 274. The form 278 is a porous medium made of a porous material, and, in the present embodiment, is made of a synthetic resin (for example, polyethylene terephthalate). In another embodiment, the form 278 can be formed of a combination with a metal spring.

The liquid outflow part 274 has a first surface **274*f* and a second surface 274*s*. The first surface 274*f* and the second surface 274*s* form a middle part of the liquid outflow part 274. The second surface 274*s* is an inclined surface that connects between the first surface 274*f* and the welded part 276, and forms an edge of the liquid outflow part 274**.

The communication port 280 of the cartridge 20 is provided to inside the liquid supply part 260, and leads through the interior of the main body member 301 continuously through to the air inlet 209. Therefore, the air pressure inside the liquid supply part 260 is adjusted through the communication port 280, even in a case where the liquid supply port 262 of the liquid supply part 260 has been sealed. The balance of pressure between the liquid supply part 260 and the liquid storage part 310 is thereby maintained respectively in the state where the cartridge 20 has been mounted onto the printer 80 and the state where the cover 50 has been mounted onto the cartridge 20. As such, the entry of air to inside the cartridge 20 from the liquid outflow part 274 is prevented, and the leakage of the ink to outside the cartridge 20 from the liquid outflow part 274 is prevented.

A-4. Detailed Configuration of the Cover

Figure 9:
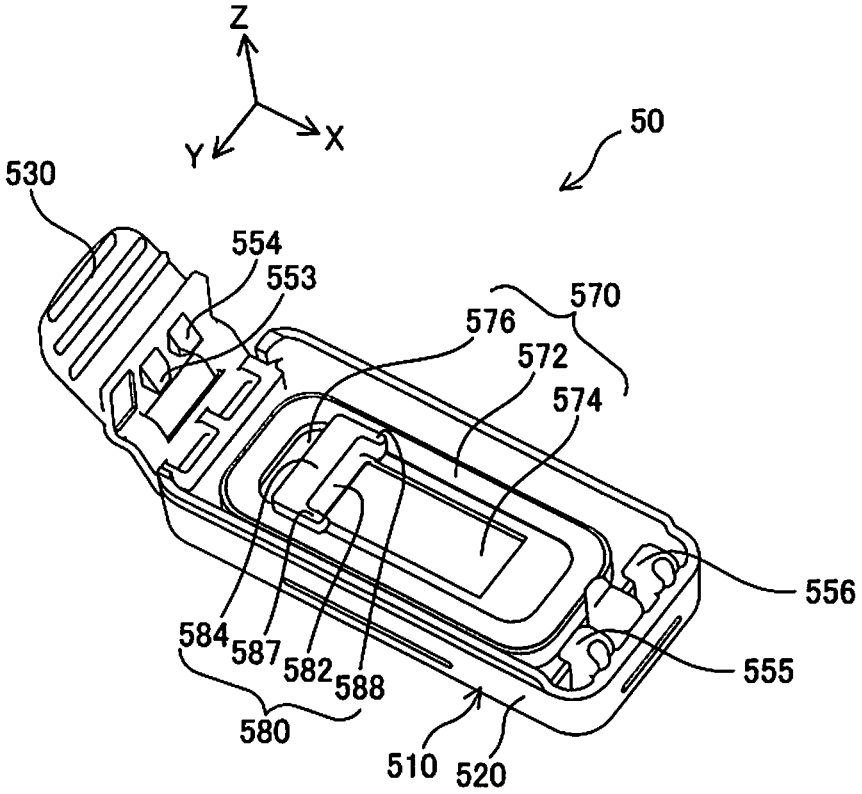
FIG. 9 is a perspective view where a cover is viewed obliquely from above.
Figure 10:
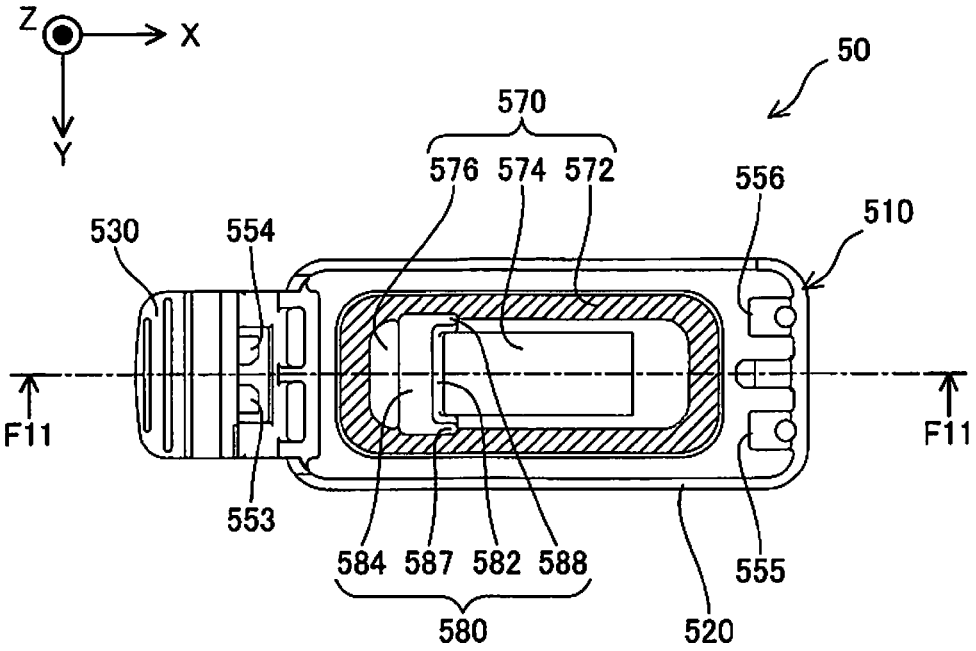
FIG. 10 is a descriptive view where a cover is viewed from above.
Figure 11:
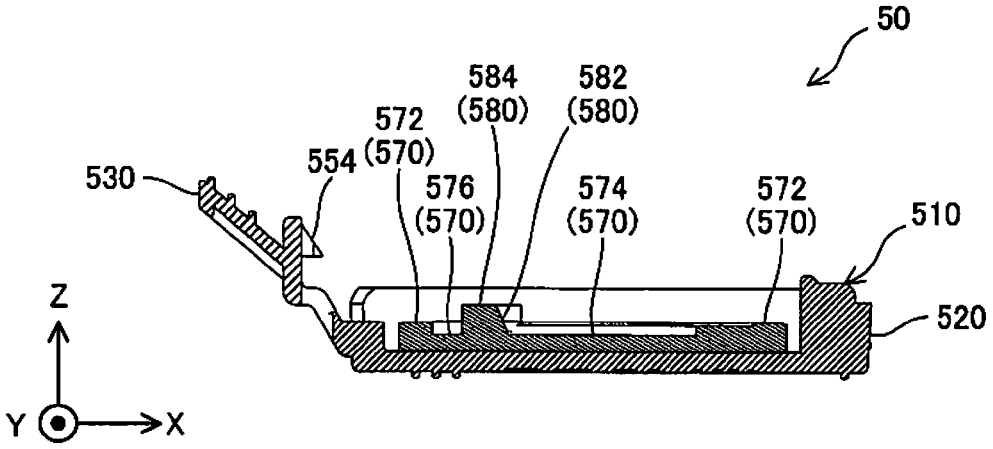
FIG. 11 is a cross-sectional view where a cover is transected.
Figure 12:
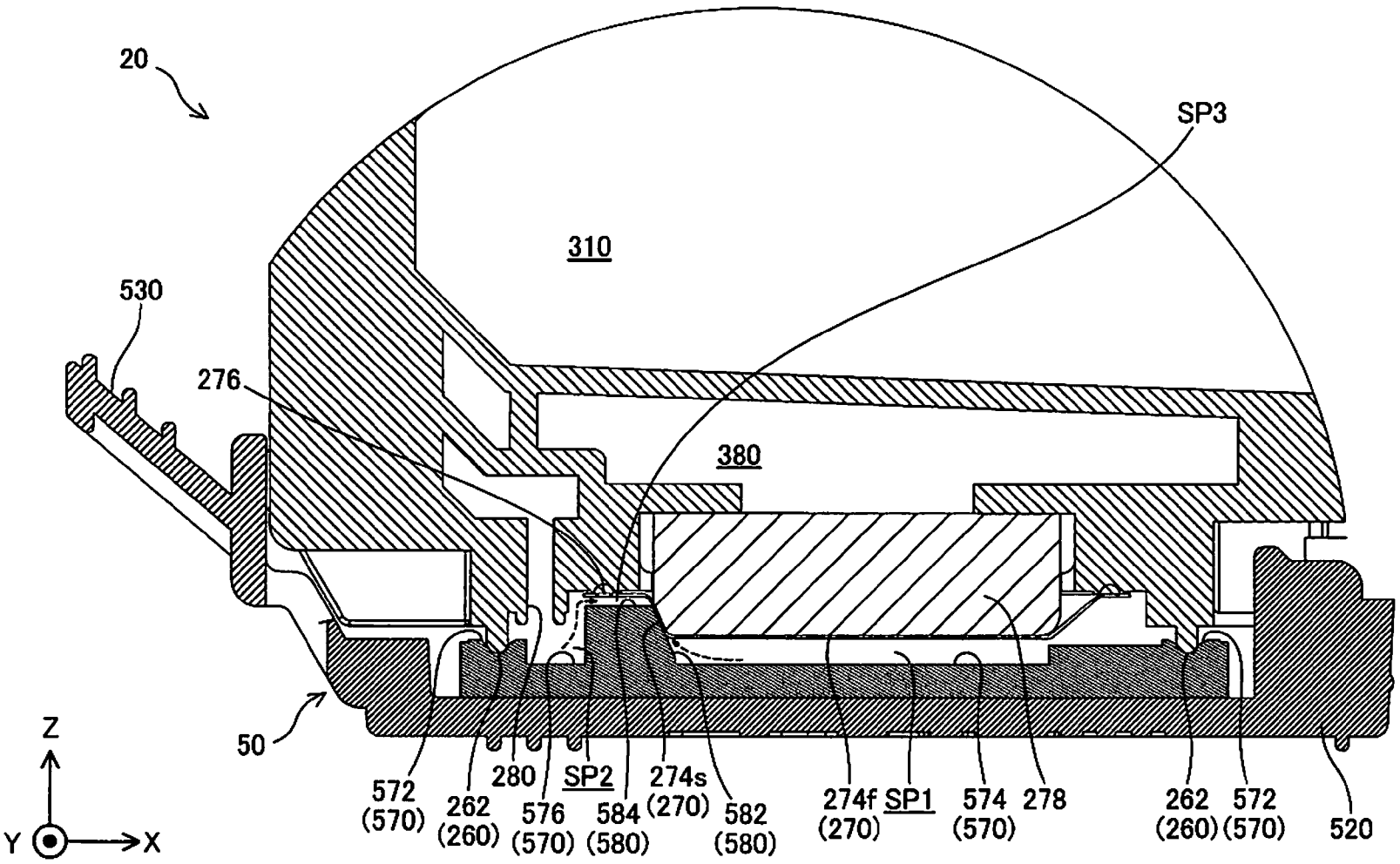
FIG. 12 is an enlarged cross-sectional view where a cover mounted onto a cartridge is transected.

FIG. 9 is a perspective view where the cover 50 is viewed obliquely from above. FIG. 10 is a descriptive view where the cover 50 is viewed from above. FIG. 11 is a cross-sectional view where the cover 50 is transected. FIG. 12 is an enlarged cross-sectional view where the cover 50 mounted onto the cartridge 20 is transected. FIG. 11 depicts the cover 50 as transected along the arrow F11-F11 in FIG. 10. FIG. 12 depicts the cover 50 as transected along with the cartridge 20 in a similar positional relationship to that of the cover 50 in FIG. 11. When the cover 50 is described, the X-, Y-, Z-axes with respect to the cover 50 in a state of having been mounted onto the cartridge 20 are understood to be the axes on the cover 50.

The cover 50 is configured so as to be detachable from the cartridge 20. The cover 50 closes off the liquid supply port 262 of the cartridge 20 in the state of having been mounted onto the cartridge 20. The cover 50 is provided with a base 510, a sealing part 570, and a contact part 580.

The base 510 of the cover 50 is joined to the sealing part 570 and engages with the cartridge 20, thereby fixing the sealing part 570 to the liquid supply part 260. The base 510 is made of a synthetic resin (for example, polypropylene) that is more rigid than the sealing part 570. In the present embodiment, the base 510 is bonded to the sealing part 570 at a step where the base 510 is molded along with the sealing part 570 by overmolding of dissimilar materials. The base 510 is provided with a cover part 520, a lever 530, protruding parts 553, 554, and protruding parts 555, 556.

The cover part 520 of the base 510 forms a lid shape that covers the liquid supply part 260. In the present embodiment, the cover part 520 forms such a shape that walls are provided perpendicularly to each side of a rectangle larger than the liquid supply port 262 of the liquid supply part 260. The sealing part 570 is joined to the inside of the cover part 520.

The lever 530 of the base 510 is formed on the −X-axis direction side of the cover part 520, and forms a shape that protrudes out in the −X-axis direction and +Z-axis direction from the cover part 520. Pulling the lever 530 in the −Z-axis direction while also pinching the lever 530 allows the user to remove the cover 50 from the cartridge 20.

The protruding parts 553, 554 of the base 510 are formed on the lever 530, and form a shape that protrudes out in the +X-axis direction from the lever 530. The protruding part 553 is located on the +Y-axis direction side and the protruding part 554 is located on the −Y-axis direction side. In the state where the cover 50 has been mounted onto the cartridge 20, the protruding part 553 engages with the concavity 253 of the cartridge 20 and the protruding part 554 engages with the concavity 254 of the cartridge 20. The −X-axis direction side of the cover 50 is thereby fixed to the cartridge 20. In the state where the cover 50 has been mounted onto the cartridge 20, in a case where the lever 530 is pulled in the −Z-axis direction, then the protruding parts 553, 554 enter a state of having been disengaged from the concavities 253, 254 of the cartridge 20. The mounting of the cover 50 onto the cartridge 20 is thereby released.

The protruding parts 555, 556 of the base 510 are formed on the +X-axis direction side of the cover part 520, and form a shape that protrudes out toward the inside of the cover part 520. The protruding part 555 is located on the +Y-axis direction side and the protruding part 556 is located on the −Y-axis direction side. In the state where the cover 50 has been mounted onto the cartridge 20, the protruding part 555 engages with the concavity 255 of the cartridge 20 and the protruding part 556 engages with the concavity 256 of the cartridge 20. The +X-axis direction side of the cover 50 is thereby fixed to the cartridge 20.

In the state where the cover 50 has been mounted onto the cartridge 20, the sealing part 570 of the cover 50 contacts with the liquid supply part 260 of the cartridge 20 and thereby seals the liquid supply port 262. Also, the sealing part 570 and the liquid outflow part 274 form a space SP1 therebetween. The sealing part 570 is made of a synthetic resin (for example, an elastomer) that is more rigid than the base 510. The sealing part 570 has an annular surface 572, a concavity 574, and a concavity 576.

The annular surface 572 of the sealing part 570 is an annular surface that runs along the XY-plane. The annular surface 572 forms a shape that corresponds to the liquid supply port 262 of the cartridge 20, and, in the state where the cover 50 has been mounted onto the cartridge 20, contacts with the entire area of the liquid supply port 262. The space between the liquid supply port 262 and the annular surface 572 is thereby sealed tight in the state where the cover 50 has been mounted onto the cartridge 20.

The concavity 574 of the sealing part 570 is formed on the inside of the annular surface 572 and further to the +X-axis direction side than the contact part 580, and forms a shape that is recessed to the −Z-axis direction side beyond the annular surface 572. In the state where the cover 50 has been mounted onto the cartridge 20, the concavity 574 and the liquid outflow part 274 of the cartridge 20 form the space SP1 therebetween.

The concavity 576 of the sealing part 570 is formed on the inside of the annular surface 572 and further to the −X-axis direction side than the contact part 580, and forms a shape that is recessed to the −Z-axis direction side beyond the annular surface 572. In the state where the cover 50 has been mounted onto the cartridge 20, the concavity 576 and the cartridge 20 form a space SP2 therebetween. The space SP2 leads through to the space SP1 via a space (not shown) formed between the +Y-axis direction side and −Y-axis direction side of the contact part 580 and the liquid supply part 260, and leads through to the air inlet 209 via the communication port 280. Therefore, the space SP1 leads to the air via the space SP2.

In the state where the cover 50 has been mounted onto the cartridge 20, the contact part 580 of the cover 50 contacts with a part of the liquid outflow part 274 of the cartridge 20. In the present embodiment, the contact part 580 is located nearer the −X-axis direction in the inside of the annular surface 572 of the sealing part 570, and, in the state where the cover 50 has been mounted onto the cartridge 20, contacts with the second surface 274*s* that is located on the communication port 280 side (−X-axis direction side) in the liquid outflow part 274. In another embodiment, the contact part 580 can contact with the first surface 274*f* in the liquid outflow part 274 in the state where the cover 50 has been mounted onto the cartridge 20, or can contact with another site (the +X-axis direction side, the +Y-axis direction side, or the −Y-axis direction side) in the second surface 274*s*.

The contact part 580 is made of a non-porous material that does not have pores. In the present embodiment, the contact part 580 is integrally molded with the sealing part 570, and is made of the same synthetic resin as the sealing part 570. In another embodiment, the contact part 580 can be a member that is molded separately from the sealing part 570, or can be a member made of a material different from that of the sealing part 570.

The contact part 580 forms a shape (which, in the present embodiment, is convex) that protrudes out from the sealing part 570. In the present embodiment, the contact part 580 forms a shape that protrudes out to the +Z-axis direction from the sealing part 570. The contact part 580 has an inclined part 582, an upper part 584, and walls 587, 588.

The inclined part 582 of the contact part 580 is a portion (which, in the present embodiment, is a surface) that is inclined toward the +Z-axis direction with respect to the annular surface 572 of the sealing part 570. The inclined part 582 is a portion (which, in the present embodiment, is a surface) that is inclined toward the +X-axis direction and the +Z-axis direction with respect to the annular surface 572. In the state where the cover 50 has been mounted onto the cartridge 20, the inclined part 582 is, going toward the liquid outflow part 274, increasingly inclined toward the outer peripheral side of the liquid outflow part 274 (in other words, is inclined with respect to the middle part of the liquid outflow part 274), and also contacts with the liquid outflow part 274. Therefore, a capillary force going toward the liquid outflow part 274 acts on the ink that is present between the liquid outflow part 274 and the inclined part 582. This causes the ink that has collected in the space SP1 to arrive at the liquid outflow part 274 by way of the inclined part 582, as illustrated with the arrow in the space SP1 in FIG. 12, when the −X-axis direction side of the cartridge 20 onto which the cover 50 has been mounted is oriented in the direction of the force of gravity, and causes the ink to be sucked back to the secondary storage part 380 side from the liquid outflow part 274 due to the negative pressure that is inside the liquid storage part 310.

The upper part 584 of the contact part 580 is a portion that leads to the inclined part 582, and forms the top of the contact part 580. In the present embodiment, the upper part 584 leads to the inclined part 582 at the +X-axis direction side. In the present embodiment, the upper part 584 is a portion (which, in the present embodiment, is a surface) that runs along the XY-plane.

In the present embodiment, the upper part 584 is a facing part facing the welded part 276 of the cartridge 20 in the state where the cover 50 has been mounted onto the cartridge 20. In the present embodiment, the upper part 584 and the welded part 276 form a space SP3 therebetween. In the present embodiment, a capillary force going toward the liquid outflow part 274 acts on the ink that is present in the space SP3. This causes the ink that has collected in the space SP2 to arrive at the liquid outflow part 274 by way of the space SP3, as illustrated with the arrow in the space SP2 in FIG. 12, when the +X-axis direction side of the cartridge 20 onto which the cover 50 has been mounted is oriented in the direction of the force of gravity, and causes the ink to be sucked back to the secondary storage part 380 side from the liquid outflow part 274 due to the negative pressure that is inside the liquid storage part 310.

The walls 587, 588 of the contact part 580 prevent the ink that is flowing through the inclined part 582 toward the liquid outflow part 274 from leaking out to the space SP2. In the present embodiment, the wall 587 is formed on the +Y-axis direction side of the inclined part 582, and is a site that protrudes out to the +X-axis direction side beyond the inclined part 582; the wall 588 is formed on the −Y-axis direction side of the inclined part 582, and is a site that protrudes out to the +X-axis direction side beyond the inclined part 582.

A-5. Effects

According to the first embodiment described above, a capillary force going toward the liquid outflow part 274 can be made to act on the ink that is present between the liquid outflow part 274 and the contact part 580. This makes it possible to gather, to the liquid outflow part 274, the ink that is present at the periphery of the contact part 580 out of ink that has leaked out to the cover 50 from the liquid outflow part 274. The ink that has been gathered to the liquid outflow part 274 in this manner returns to the liquid storage part 310 by way of the liquid outflow part 274 due to the negative pressure inside the liquid storage part 310. As such, the extent to which ink that has leaked out to the cover 50 from the liquid outflow part 274 goes to waste can be curbed.

In the state where the cover 50 has been mounted onto the cartridge 20, the contact part 580 contacts with a site on the communication port 280 side in the liquid outflow part 274. Therefore, according to the first embodiment, when ink that has leaked out to the cover 50 from the liquid outflow part 274 flows to the communication port 280 side, then the ink can be returned to the liquid storage part 310 via the contact part 580 in advance of the communication port 280. This makes it possible for the ink to be kept from flowing into the communication port 280. As such, the extent to which ink that has flowed into the communication port 280 becomes unusable and goes to waste can be curbed.

Further, the contact part 580 has the upper part 584, which faces the welded part 276 in the state where the cover 50 has been mounted onto the cartridge 20. Therefore, according to the first embodiment, the hitting of the upper part 584 against the welded part 276 makes it possible to prevent damage to the liquid outflow part 274 caused by an excessive pressing of the contact part 580.

Further, the upper part 584 and the welded part 276 form the space SP3 therebetween that causes a capillary force going toward the liquid outflow part 274 to act on the ink that is present between the upper part 584 and the welded part 276 in the state where the cover 50 has been mounted onto the cartridge 20. Therefore, according to the first embodiment, ink that is present in the periphery of the upper part 584 out of ink that has leaked out to the cover 50 from the liquid outflow part 274 can be gathered to the liquid outflow part 274 via the space SP3. As such, the extent to which ink that has leaked out to the cover 50 from the liquid outflow part 274 goes to waste can be curbed even further.

B. Second Embodiment

Figure 13:
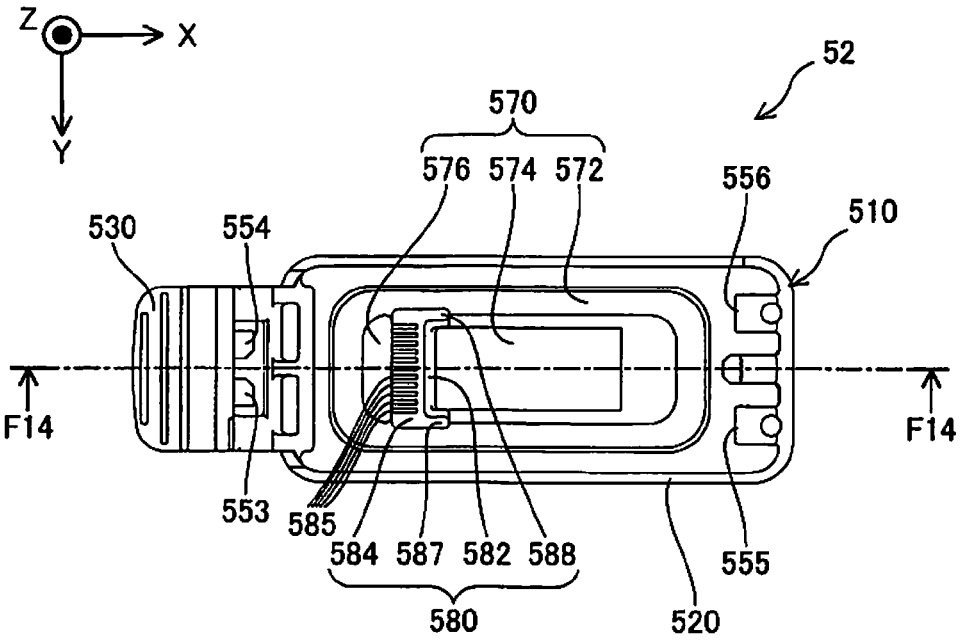
FIG. 13 is a descriptive view where a cover in a second embodiment is viewed from above.
Figure 14:
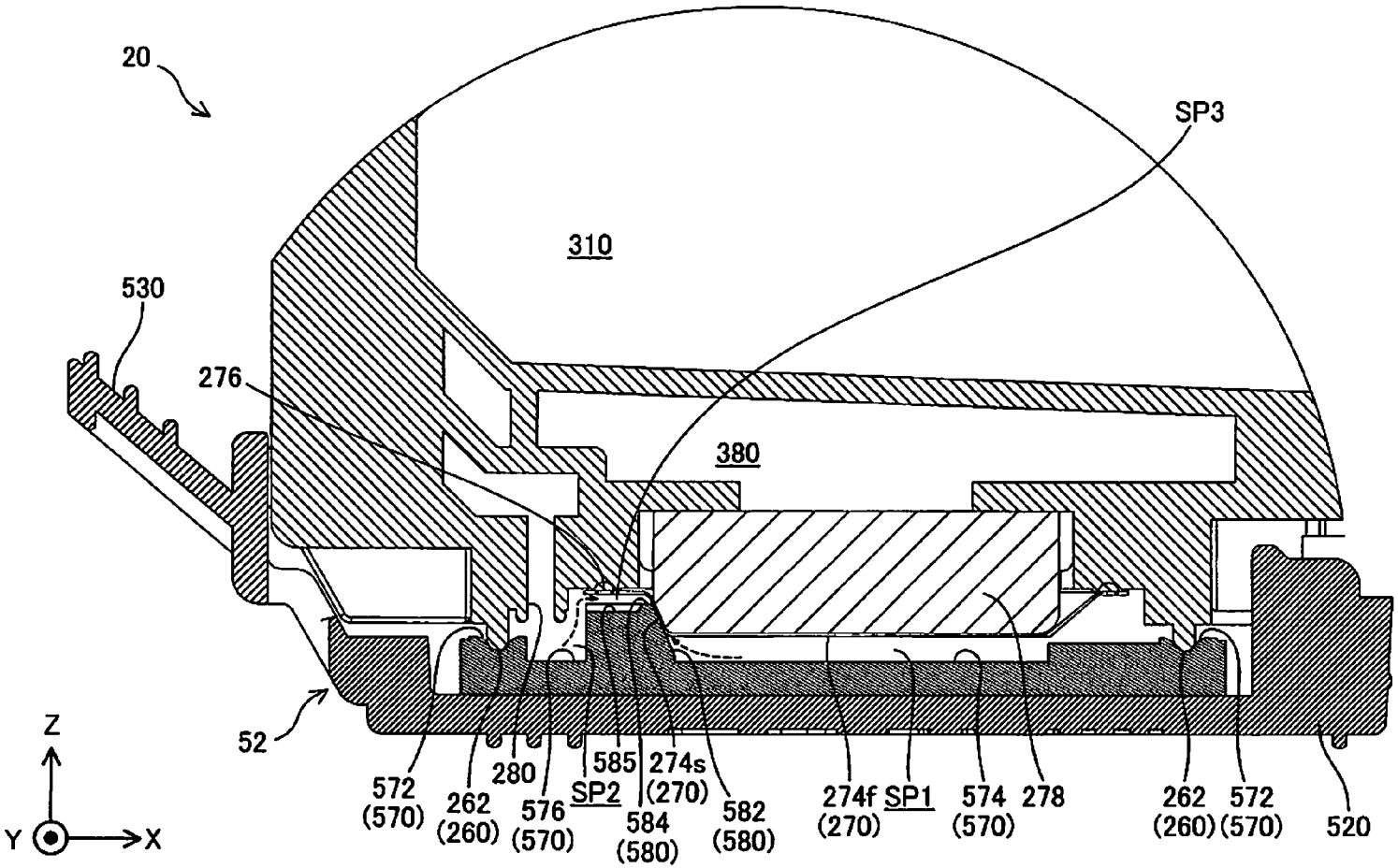
FIG. 14 is an enlarged cross-sectional view where a cover in the second embodiment is transected.

FIG. 13 is a descriptive view where a cover 52 in a second embodiment is viewed from above. FIG. 14 is an enlarged cross-sectional view where the cover 52 in the second embodiment is transected. FIG. 14 depicts the cover 52 as being transected along with the cartridge 20 along the arrow F14-F14 in FIG. 13. The liquid jet system 10 of the second embodiment is similar to that of the first embodiment, except in that the cover 52, which is different from that of the first embodiment, is mounted onto the cartridge 20.

The cover 52 of the second embodiment is similar to that of the first embodiment, except in that grooves 585 extending from the communication port 280 side to the inclined part 582 side (in other words, towards the inclined part 582) are formed on the upper part 584 of the contact part 580. In the present embodiment, a plurality of grooves 585 are formed on the upper part 584. In another embodiment, there can be a single groove 585 formed on the upper part 584. A capillary force going toward the inclined part 582 acts on the ink that is present on the inside of the grooves 585.

According to the second embodiment, similarly with respect to the first embodiment, the extent to which ink that has leaked out to the cover 52 from the liquid outflow part 274 goes to waste can be curbed. Further, because the grooves 585 are formed on the upper part 584 of the contact part 580 according to the second embodiment, causing a capillary force going toward the inclined part 582 to act on the ink that is present in the grooves 585 of the upper part 584 makes it possible to gather, to the liquid outflow part 274 via the grooves 585 of the upper part 584, the ink that has come around to the space SP2 that is the opposite side of the inclined part 582 in the contact part 580, out of the ink that has leaked out to the cover 52 from the liquid outflow part 274. As such, the extent to which ink that has leaked out to the cover 52 from the liquid outflow part 274 goes to waste can be curbed even further.

C. Third Embodiment

Figure 15:
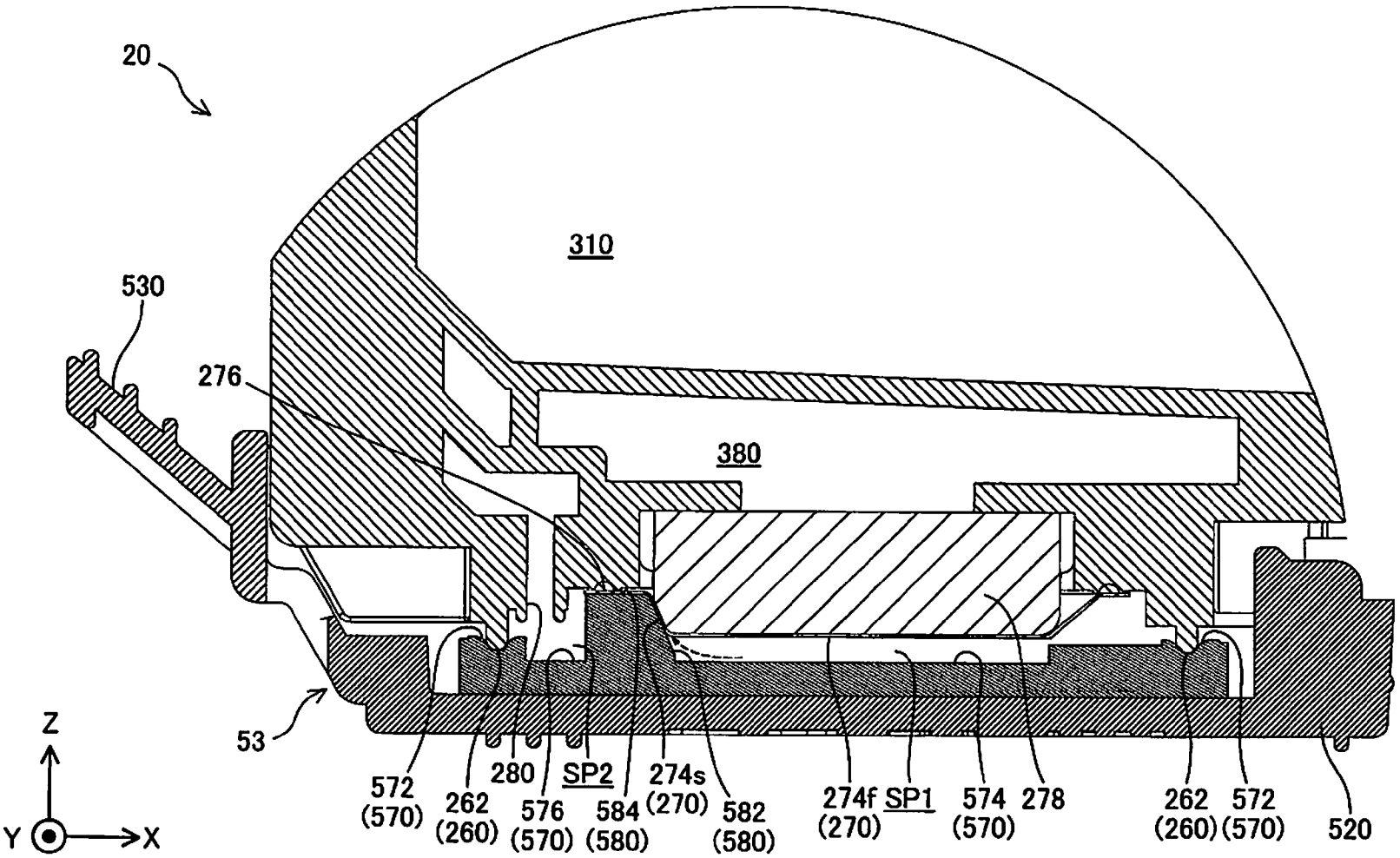
FIG. 15 is an enlarged cross-sectional view where a cover in a third embodiment is transected.

FIG. 15 is an enlarged cross-sectional view where a cover 53 in a third embodiment is transected. FIG. 15 depicts the cover 53 as transected along with the cartridge 20 in a positional relationship similar to that of FIG. 12. The liquid jet system 10 of the third embodiment is similar to that of the first embodiment, except in that a cover 53 which is different from that of the first embodiment is mounted onto the cartridge 20. The cover 53 of the third embodiment is similar to that of the first embodiment, except in that the upper part 584 of the contact part 580 contacts with the welded part 276 of the cartridge 20 in the state where the cover 53 is mounted onto the cartridge 20.

According to the third embodiment, similarly with respect to the first embodiment, the inclined part 582 of the contact part 580 makes it possible to curb the extent to which the ink that has leaked out to the cover 52 from the liquid outflow part 274 goes to waste. Further, because the upper part 584 of the contact part 580 contacts with the welded part 276 of the cartridge 20 in the state where the cover 53 has been mounted onto the cartridge 20, the upper part 584 makes it possible to hinder the flow of the ink going toward the outside of the liquid outflow part 274 beyond the welded part 276. As such, the extent to which ink that has leaked out to the cover 53 from the liquid outflow part 274 goes to waste can be curbed even further.

D. Fourth Embodiment

Figure 16:
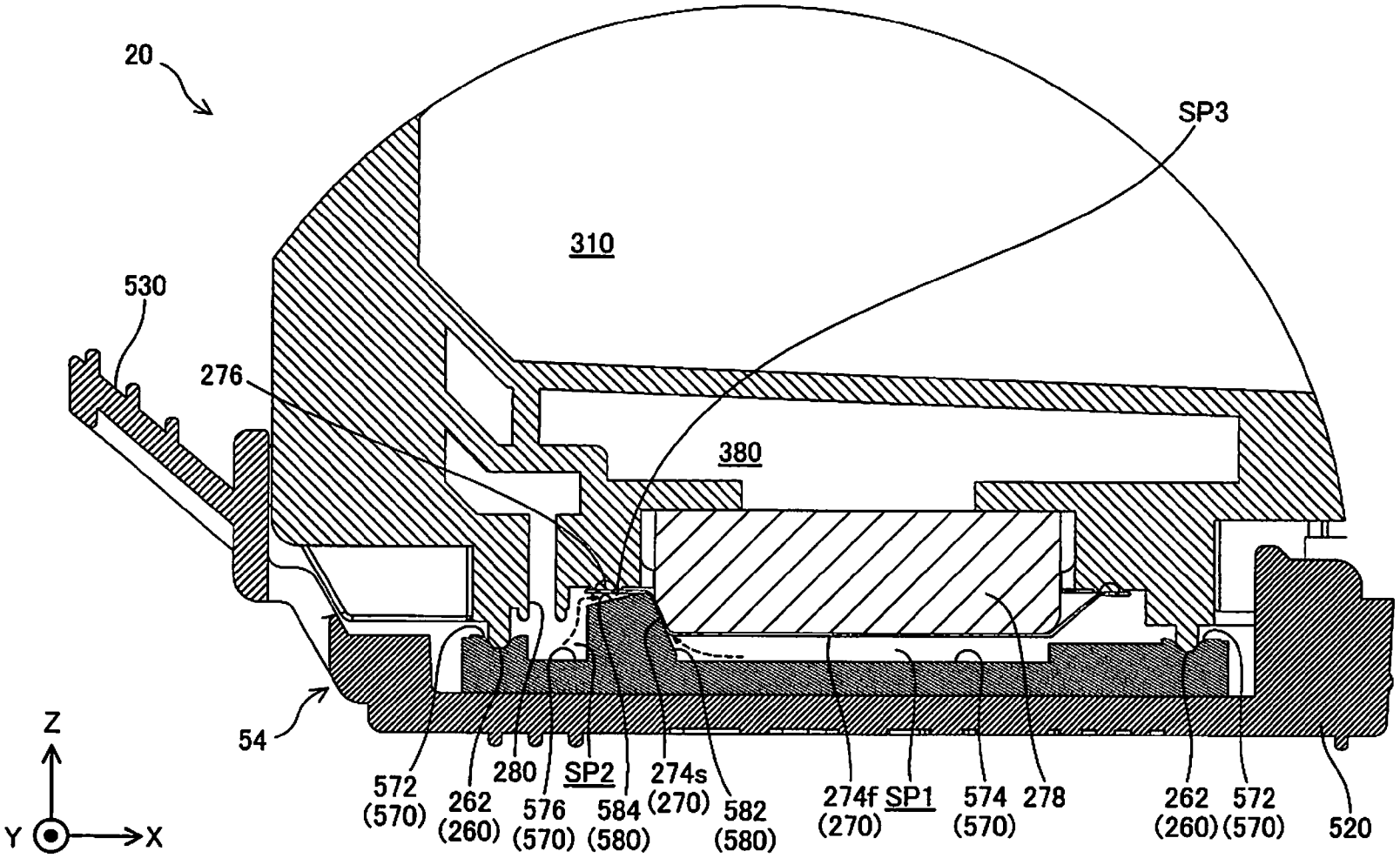
FIG. 16 is an enlarged cross-sectional view where a cover in a fourth embodiment is transected.

FIG. 16 is an enlarged cross-sectional view where a cover 54 in a fourth embodiment is transected. FIG. 16 depicts the cover 54 as transected along with the cartridge 20 in a positional relationship similar to that of FIG. 12. The liquid jet system 10 of the fourth embodiment is similar to that of the first embodiment, except in that a cover 54 which is different from that of the first embodiment is mounted onto the cartridge 20.

The cover 54 of the fourth embodiment is similar to that of the first embodiment except in that the shape of the upper part 584 on the contact part 580 is different. The upper part 584 of the fourth embodiment is a portion (which, in the present embodiment, is a surface) that, going increasingly toward the inclined part 582, goes increasingly toward the +Z-axis direction. The upper part 584 and the welded part 276 form the space SP3 therebetween in the state where the cover 54 has been mounted onto the cartridge 20. In the present embodiment, the space SP3 narrows going increasingly toward the liquid outflow part 274, and a capillary force going toward the liquid outflow part 274 acts on the ink that is present in the space SP3.

According to the fourth embodiment, similarly with respect to the first embodiment, the extent to which ink that has leaked out to the cover 54 from the liquid outflow part 274 goes to waste can be curbed.

E. Fifth Embodiment

Figure 17:
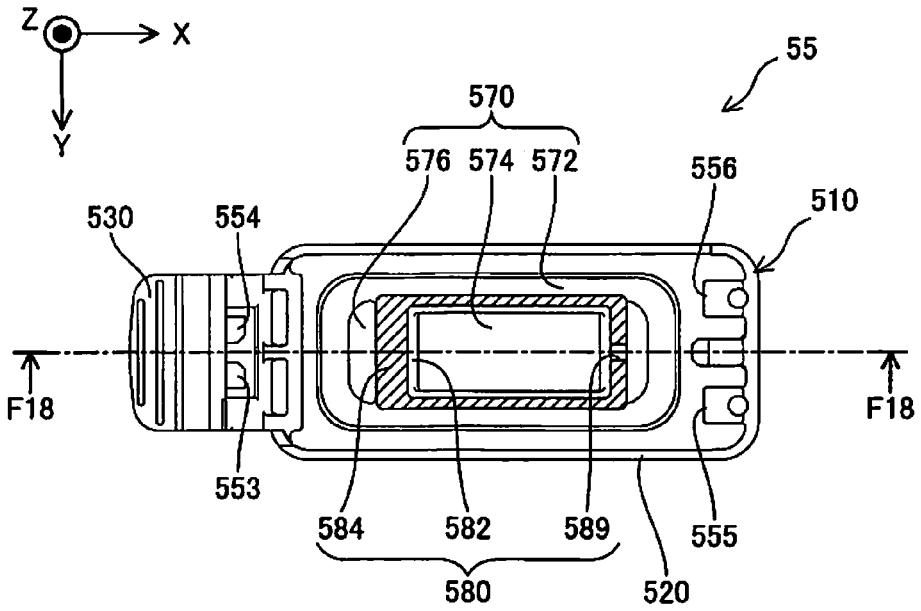
FIG. 17 is a descriptive view where a cover in a fifth embodiment is viewed from above.
Figure 18:
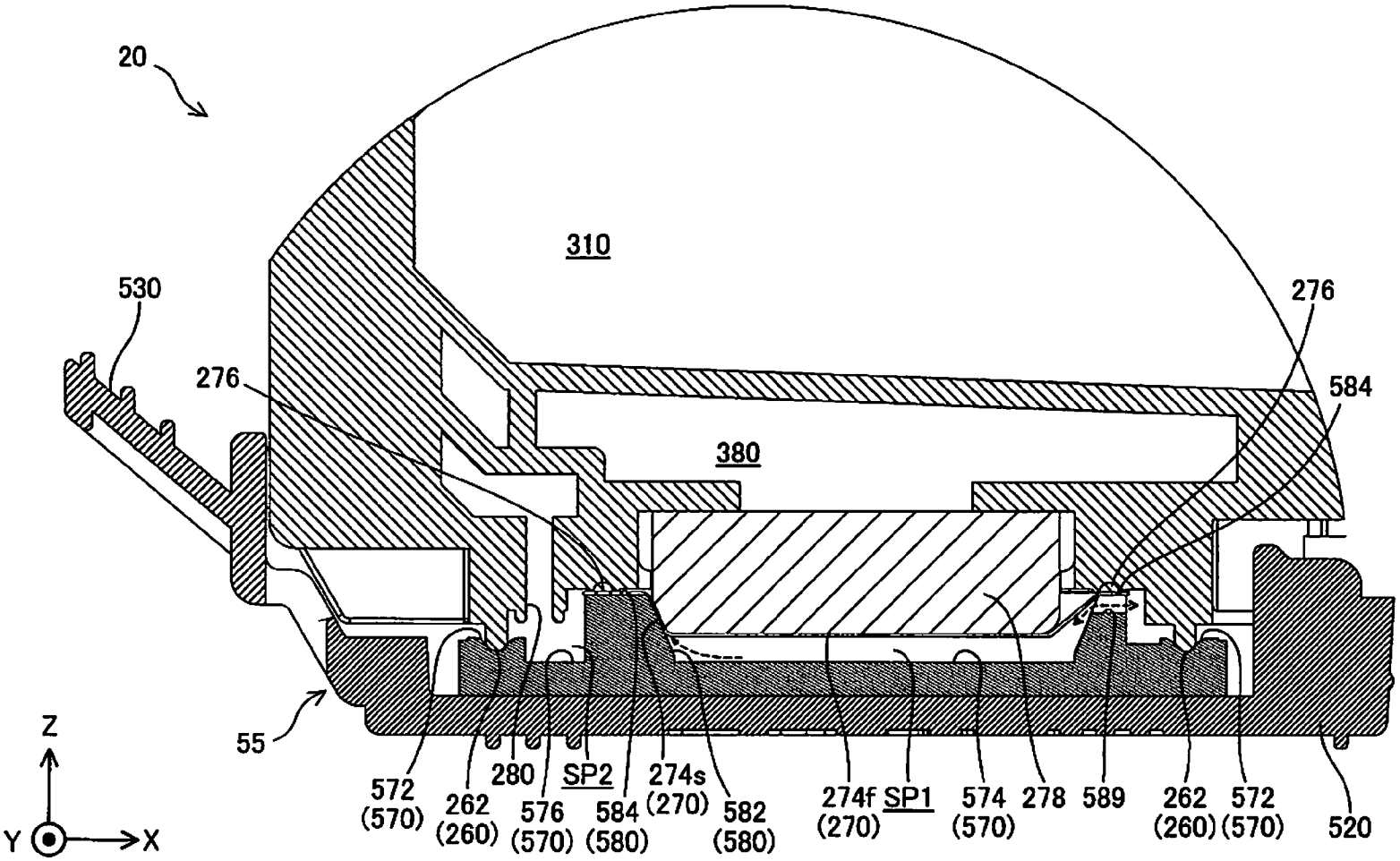
FIG. 18 is an enlarged cross-sectional view where a cover in the fifth embodiment is transected.

FIG. 17 is a descriptive view where a cover 55 in a fifth embodiment is viewed from above. FIG. 18 is an enlarged cross-sectional view where the cover 55 in the fifth embodiment is transected. FIG. 18 depicts the cover 55 as transected along with the cartridge 20 along the arrow F18-F18 in FIG. 17. The liquid jet system 10 of the fifth embodiment is similar to that of the first embodiment, except in that the cover 55 which is different from that of the first embodiment is mounted onto the cartridge 20.

The cover 55 of the fifth embodiment is similar to that of the first embodiment except in that the shape of the upper part 584 in the contact part 580 is different. In the fifth embodiment, the upper part 584 forms a shape that surrounds the periphery of the concavity 574 of the sealing part 570, and an opening 589 linking the inside and outside of the upper part 584 is formed on a part of the upper part 584. FIG. 17 depicts the upper part 584 with hatching. In the fifth embodiment, the upper part 584 functions as a surrounding part that surrounds the liquid outflow part 274 and also contacts with the welded part 276, except for the site where the opening 589 is formed, in the state where the cover 55 has been mounted onto the cartridge 20.

In the fifth embodiment, the space SP1 formed on the inside of the upper part 584 leads through to the space SP2 via the opening 589. For this reason, the space SP1 is linked to the air via the opening 589 and the space SP2.

According to the fifth embodiment, similarly with respect to the first embodiment, the extent to which ink that has leaked out to the cover 55 from the liquid outflow part 274 goes to waste can be curbed. Also, according to the fifth embodiment, the upper part 584 functioning as the surrounding part makes it possible to hinder the ink that has leaked out to the cover 55 from the liquid outflow part 274 from drawing away from the liquid outflow part 274, while also the opening 589 makes it possible to prevent the air that is present in the space SP1 from entering into the liquid storage part 310 by way of the liquid outflow part 274 because of a change in air pressure. This makes it possible to effectively gather, to the liquid outflow part 274, the ink that has leaked out to the cover 55.

F. Other Embodiments

The present invention is not limited to the embodiments or working examples described above, nor to the modification examples, and can be realized in a variety of configurations within a scope that does not depart from the essence thereof. For example, the technical features in the embodiments, working examples, or modification examples corresponding to the technical features in each of the aspects set forth in the section on the Summary of the Invention can be replaced or combined as appropriate in order to solve in part or in total the objectives stated above, or in order to achieve in part or in total the effects stated above. The technical features thereof, where not described as being essential in the description, can also be removed as appropriate.

The present invention is not limited to an inkjet printer and an ink cartridge therefor, but rather could also be applied to a liquid jet apparatus for jetting another liquid different from ink, and a liquid storage container therefor. For example, the present invention can be applied to the following variety of liquid jet apparatuses and liquid storage containers therefor.

an image recording apparatus, such as a facsimile apparatus a color material jet apparatus used to manufacture a color filter for an image display apparatus such as a liquid crystal display an electrode material jet apparatus used in electrode formation for an organic electroluminescence (EL) display, a field emission display (FED), or the like a liquid jet apparatus for jetting a liquid including a bio-organic material used to manufacture bio-chips a sample jet apparatus, serving as a precision pipette an apparatus for jetting a lubricant an apparatus for jetting a resin solution a liquid jet apparatus for jetting a lubricant at pin points for a precision machine such as a timepiece or camera a liquid jet apparatus for jetting, onto a substrate, a transparent resin solution such as an ultraviolet ray-curable resin for forming, inter alfa, a hemispherical micro lens (optical lens) used in an optical communication element or the like a liquid jet apparatus for jetting an acid or alkali etching solution in order to etch a substrate or the like any other desired liquid jet apparatus provided with a liquid jet head for discharging droplets of a minute quantity "Droplets" here refers to the state of a liquid discharged from the liquid jet apparatus, and in addition to a granular liquid or lacrimal liquid, also encompasses liquids that are drawn out into filaments. The "liquid" should be a material that can be jetted by the liquid jet apparatus. For example, the "liquid" can be a material where the substance is in a liquid-phase state, and also the "liquid" encompasses materials in a liquid state such as a sol, gel water, inorganic solvent, organic solvent, solution, liquid resin, or liquid metal (molten metal). The "liquid" moreover encompasses a liquid as one state of a substance, but also particles of a functional material made of solid matter, such as pigments or metal particle, that have been dissolved, dispersed, or mixed into a solvent, and the like. Representative examples of liquids include an ink or a liquid crystal. Herein, "ink" encompasses a variety of liquid compositions, such as typical water-based inks and oil-based inks as well as gel inks and hot melt inks.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only a selected embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiment according to the present invention are provided for illustration only, and not for the purpose of limiting the invention as defined by the appended claims and their equivalents.

What is claimed is:

1. A cover configured to be mounted onto a liquid storage container that includes a liquid storage part configured to store a liquid for supply to a liquid jet apparatus, a liquid supply part having a liquid supply port that defines an opening by which the liquid is supplied to the liquid jet apparatus from the liquid storage part, and a liquid outflow part made of a porous material, the liquid outflow part being disposed inside of the liquid supply port so as to protrude out with respect to an inner wall of the liquid supply port and allowing the liquid to flow out to the liquid jet apparatus from the liquid storage part, the cover being further configured to block off the liquid supply port, the cover comprising:

a sealing part contacting with the liquid supply part and sealing off the liquid supply port in a state where the cover is mounted onto the liquid storage container, the sealing part and the liquid outflow part defining a space therebetween; and a contact part made of a non-porous material, the contact part having an inclined part that is inclined with respect to a middle part of the liquid outflow part and contacts with a protruding side surface of the liquid outflow part in the state where the cover is mounted onto the liquid storage container.

2. The cover according to claim 1, wherein the liquid supply part of the liquid storage container further has a communication port that communicates between the space and the air in the state where the cover is mounted onto the liquid storage container, and the contact part contacts with a site on the communication port side in the liquid outflow part in the state where the cover is mounted onto the liquid storage container.

3. The cover according to claim 2, wherein the liquid supply part of the liquid storage container further has a welded part that surrounds the liquid outflow part, the welded part being obtained when the porous material is welded, the contact part projects out from the sealing part, the contact part further having an upper part that is connected to the inclined part and defines a top of the contact part, and the upper part has a groove that extends from the communication port side to the inclined part side.

4. The cover according to claim 1, wherein the liquid supply part of the liquid storage container has a welded part that is obtained when the porous material is welded, and the contact part has a facing part that faces the welded part in the state where the cover is mounted onto the liquid storage container.

5. The cover according to claim 4, wherein the facing part contacts with the welded part in the state where the cover is mounted onto the liquid storage container.

6. The cover according to claim 4, wherein the facing part and the welded part define a space therebetween where a capillary force going toward the liquid outflow part is made to act on the liquid that is present between the facing part and the welded part in the state where the cover is mounted onto the liquid storage container.

7. The cover according to claim 1, wherein the liquid supply part of the liquid storage container has a welded part that is obtained when the porous material is welded, the cover further comprising a surrounding part that contacts with the welded part and surrounds the liquid outflow part in the state where the cover is mounted onto the liquid storage container, the surrounding part having an opening that links inside of the surrounding part to the air in the state where the cover is mounted onto the liquid storage container.

8. A liquid storage container comprising:

a liquid storage part configured to store a liquid for supply to a liquid jet apparatus;

a liquid supply part having a liquid supply port that defines an opening by which the liquid is supplied to the liquid jet apparatus from the liquid storage part;

a liquid outflow part made of a porous material, the liquid outflow part being disposed inside of the liquid supply port so as to protrude out with respect to an inner wall of the liquid supply port and allowing the liquid to flow out to the liquid jet apparatus from the liquid storage part; and a cover blocking off the liquid supply port, the cover including a sealing part contacting with the liquid supply part and sealing off the liquid supply port, the sealing part and the liquid outflow part defining a space therebetween, and a contact part made of a non-porous material, the contact part having an inclined part that is inclined with respect to a middle part of the liquid outflow part and contacts with a protruding side surface of the liquid outflow part.

9. The liquid storage container according to claim 8, wherein the liquid supply part further has a communication port that communicates between the space and the air, and the contact part contacts with a site on the communication port side in the liquid outflow part.

10. The liquid storage container according to claim 9, wherein the liquid supply part further has a welded part that surrounds the liquid outflow part, the welded part being obtained when the porous material is welded, the contact part projects out from the sealing part, the contact part further having an upper part that is connected to the inclined part and defines a top of the contact part, and the upper part has a groove that extends from the communication port side to the inclined part side.

11. The liquid storage container according to claim 8, wherein the liquid supply part has a welded part that is obtained when the porous material is welded, and the contact part has a facing part that faces the welded part.

12. The liquid storage container according to claim 11, wherein the facing part contacts with the welded part.

13. The liquid storage container according to claim 11, wherein the facing part and the welded part define a space therebetween where a capillary force going toward the liquid outflow part is made to act on the liquid that is present between the facing part and the welded part.

14. The liquid storage container according to claim 8, wherein the liquid supply part has a welded part that is obtained when the porous material is welded, the cover further includes a surrounding part that contacts with the welded part and surrounds the liquid outflow part, and the surrounding part has an opening that links inside of the surrounding part to the air.

15. A cover configured to be mounted onto a liquid storage container that includes an outer casing including a wall, a liquid storage part provided inside of the outer casing and configured to store a liquid, a liquid supply part having a cylindrical shape and projecting out in a direction from the wall, and a filter configured to allow the liquid to flow out from the liquid storage part to a liquid jet apparatus, the filter being welded to an inside of the liquid supply part at a welded part, the filter including a first surface and a second surface, the first surface and the second surface being protruded out to the direction from the welded part, the second surface being inclined to the direction and connecting the first surface and the welded part, the cover comprising:

a sealing part contacting with the liquid supply part and sealing off the filter in a state where the cover is mounted onto the liquid storage container, the sealing part and the filter defining a space therebetween; and a contact part made of a non-porous material, the contact part including an inclined part inclined to the direction, the inclined part contacting with the second surface of the filter in the state where the cover is mounted onto the liquid storage container.

16. The cover according to claim 15, wherein the liquid storage container further includes an air inlet provided on the outer casing and a communication port provided inside the liquid supply part, the communication port being configured to communicate the space with the air inlet in the state where the cover is mounted onto the liquid storage container, and the contact part contacts with a site on the communication port side in the liquid outflow part in the state where the cover is mounted onto the liquid storage container.

17. The cover according to claim 15, wherein the contact part has a facing part that faces the welded part in the state where the cover is mounted onto the liquid storage container, and the facing part and the welded part define a space therebetween where a capillary force going toward the liquid outflow part is made to act on the liquid that is present between the facing part and the welded part in the state where the cover is mounted onto the liquid storage container.

18. A liquid storage container comprising:

an outer casing including a wall;

a liquid storage part provided inside of the outer casing and configured to store a liquid;

a liquid supply part having a cylindrical shape and projecting out in a direction from the wall;

a liquid outflow part made of a porous material, the liquid outflow part being disposed inside of the liquid supply port and allowing the liquid to flow out to the liquid jet apparatus from the liquid storage part;

a filter configured to allow the liquid to flow out from the liquid storage part to a liquid jet apparatus, the filter being welded to an inside of the liquid supply part at a welded part, the filter including a first surface and a second surface, the first surface and the second surface being protruded out to the direction from the welded part, the second surface being inclined to the direction and connecting the first surface and the welded part; and a cover including a sealing part contacting with the liquid supply part and sealing off the filter, the sealing part and the filter defining a space therebetween, and a contact part made of a non-porous material, the contact part including an inclined part inclined to the direction, the inclined part contacting with the second surface of the filter.

19. The liquid storage container according to claim 18, further comprising:

an air inlet provided on the outer casing; and a communication port provided inside the liquid supply part, the communication port being configured to the space with the air inlet, the contact part contacting with a site on the communication port side in the liquid outflow part.

20. The liquid storage container according to claim 18, wherein the contact part has a facing part that faces the welded part, and the facing part and the welded part define a space therebetween where a capillary force going toward the liquid outflow part is made to act on the liquid that is present between the facing part and the welded part.

* * * * *